US005226922A

United States Patent [19]

Mori

[11] Patent Number: 5,226,922

[45] Date of Patent: Jul. 13, 1993

[54] CARRIER AND STORAGE STATION FOR WEFT PACKAGES

[75] Inventor: Kiyoaki Mori, Ishikawa, Japan

[73] Assignee: Tsudakoma Kogyo Kabushiki Kaisha, Kanazawa, Japan

[21] Appl. No.: 843,592

[22] Filed: Feb. 28, 1992

[30] Foreign Application Priority Data

Mar. 5, 1991 [JP] Japan ..... 3-062446

[51] Int. Cl.[5] ..... D03D 47/00

[52] U.S. Cl. ..... 139/1 R; 139/450; 414/222; 242/35.5 A; 57/281; 198/409

[58] Field of Search ..... 414/222; 139/1 R, 450; 242/35.5 A; 57/281; 198/409

[56] References Cited

U.S. PATENT DOCUMENTS

| | | | |
|---|---|---|---|
| 4,730,733 | 3/1988 | Kawamura et al. | 198/409 X |
| 4,763,773 | 8/1988 | Kawarabashi et al. | 198/409 |
| 4,846,618 | 7/1989 | Matsui | 242/35.5 A |
| 4,925,000 | 5/1990 | Pacáková et al. | 198/409 |
| 4,970,856 | 11/1990 | Taniguchi et al. | 242/35.5 A X |
| 4,979,360 | 12/1990 | Kallmann et al. | 57/281 |

FOREIGN PATENT DOCUMENTS

| | | |
|---|---|---|
| 0704298 | 4/1984 | European Pat. Off. . |
| 0384978 | 12/1989 | European Pat. Off. . |
| 3824874A1 | 2/1989 | Fed. Rep. of Germany . |
| 4006467A1 | 9/1990 | Fed. Rep. of Germany . |
| 1-317965 | 12/1989 | Japan . |
| WO8202187 | 7/1982 | World Int. Prop. O. . |
| WO8703274 | 6/1987 | World Int. Prop. O. . |

*Primary Examiner*—Andrew M. Falik

*Attorney, Agent, or Firm*—Graybeal Jackson Haley & Johnson

[57] ABSTRACT

A storage station for full weft packages transferred to a weft package stand of a weaving machine by a carrier or the carrier is provided with a direction adjusting device for arranging the direction of the full packages in a corresponding direction to the full package accepting direction of the weft package stand. A rail for the carrier is composed of a main rail and a subrail, wherein the main rail is composed of a first rail portion extending through the storage station and a second rail portion connected to the first rail portion and extending along each row of weaving machines in a weaving machine installation region, and the subrail is a closed loop subrail connected to the main rail.

4 Claims, 10 Drawing Sheets

CARRIER AND STORAGE STATION FOR WEFT PACKAGES

BACKGROUND OF THE INVENTION

1. Field of the Invention

This invention relates to a station for storing full weft packages to be supplied to a weaving machine and a carrier for transferring the full weft packages stored in the station to a weft package stand of the weaving machine and for arranging the full weft packages to the weft package stand.

2. Description of the Prior Art

A majority of weaving machines in a weaving factory are arranged, in consideration of their operating efficiencies, in a plurality of rows so that the neighboring weaving machines in two rows may face each other in their opposite directions, that is, so that the delivery sides or the take-up sides of such neighboring weaving machines may face each other. In the weft package stand of each weaving machine, a direction thereof is also determined in accordance with the direction of each weaving machine, that is, the rows of the weaving machines.

Accordingly, in case of moving a carrier which transfers the full packages from the storage station of these full packages to the weft package stand and supplies these full packages to these weaving machines along the row of the weaving machines in the same direction, the relative relation between the direction of the weft package stand to the moving direction of the carrier is different accordingly as the rows of the weaving machines. With reference to the weaving machines arranged in the same row, the relative relation is sometimes different depending on how a carrier advances into the rows of the weaving machines.

Thus, when the carrier arrives at the weft package stand where requires a full package, the full package direction held by handle means attached to the carrier must be set in consideration of the above-mentioned relative relation, for example, so as to coincide with the direction for accepting the full package of the weft package stand.

Conventionally, the full packages are preliminarily disposed within the storage station along the travel path of the carrier under the condition that the full packages are directed to a particular direction every the above-mentioned relative relation, that is, under the condition that the axial direction of the full packages is directed in the coinciding direction with the accepting direction for the full packages of the weft package stand, when the full packages are transferred to the weft package stand. The carriers are selectively stopped in the neighborhood of the full packages directed to a particular direction within the storage station, accept the full packages, transfer the full packages to the weft package stand and place the full packages at the weft package stand.

However, in the case of preparing a plurality of full packages every particular directions along the travel path of the carrier in the storage station, this becomes a hinderance to the effective utilization of the space in the storage station.

SUMMARY OF THE INVENTION

An object of the present invention is to realize the effective utilization of the storage space in a storage station for full weft packages.

The present invention provides a storage station for full weft packages transferred by a carrier to each weft package stand of weaving machines, characterized by providing a direction adjusting device for arranging the direction of the full packages in the corresponding direction to the full package accepting direction of the weft package stand.

According to the present invention, for example, one group of full packages is disposed and stored at one place and in one direction, and the directions of the full packages can be set by the direction adjusting device so as to correspond to the full package accepting direction at each weft package stand. Therefore, it is not necessary to dispose and store a plurality of groups of full packages at a plurality of places in different directions with each other, and their storage spaces can be made small. In addition, the space of the storage station can be used effectively.

The direction adjusting device is, for example, provided with a holding member for holding the full packages and a rotating plate for supporting the holding member. Accordingly, the full packages held by the holding member can be directed in a predetermined direction by rotating angularly the rotating plate.

The carrier has a pair of handle members, the full package has a handled portion held by a pair of the handle members, the direction adjusting device includes a holding member for holding the full packages, a rotating plate for supporting the holding member, and another rotating plate for supporting the rotating plate, another rotating plate being rotatable around the axis which is eccentric from the rotating axis of the rotating plate, and the handled portion can be available on the eccentric axis.

According to the present invention, after the full package is held by the holding member of the direction adjusting device, the handled portion of the full package is positioned on the rotating axis of another rotating plate by rotating the rotating plate, and further, the full package held by the holding member can be directed to a predetermined direction by rotating another rotating plate Even though the full package may be placed in any direction, the full package can be set by the handle member of the carrier so as to be able to handle the handled portion.

The present invention also provides a carrier for transferring the full packages from a storage station of full packages to each weft package stand of weaving machines and for arranging the full packages at the weft package stand, and the carrier is provided with a direction adjusting device for arranging the direction of the full package in the corresponding direction to the full package accepting direction of the weft package stand.

According to the present invention, since the carrier is provided with such a device for arranging the directions of the full packages, the full packages disposed at the storage station may be well done if such full packages are arranged only in a direction for allowing the carrier to accept the full packages. Therefore, it is not necessary to preliminarily prepare a plurality of groups of full packages in various directions corresponding to the full package accepting direction of the weft package stand. Accordingly, the excess of the space which was necessary for preliminary preparation can be applied to another use.

The direction adjusting device is rotatable around a perpendicular axis thereof and can have an ascendable and descendable handle member.

BRIEF DESCRIPTION OF THE DRAWINGS

The foregoing and other objects and features of the invention will become apparent from the following description of preferred embodiments of the invention with reference to the accompanying drawings, in which.

DETAILED DESCRIPTION OF THE PREFERRED EMBODIMENTS

Figure 1:
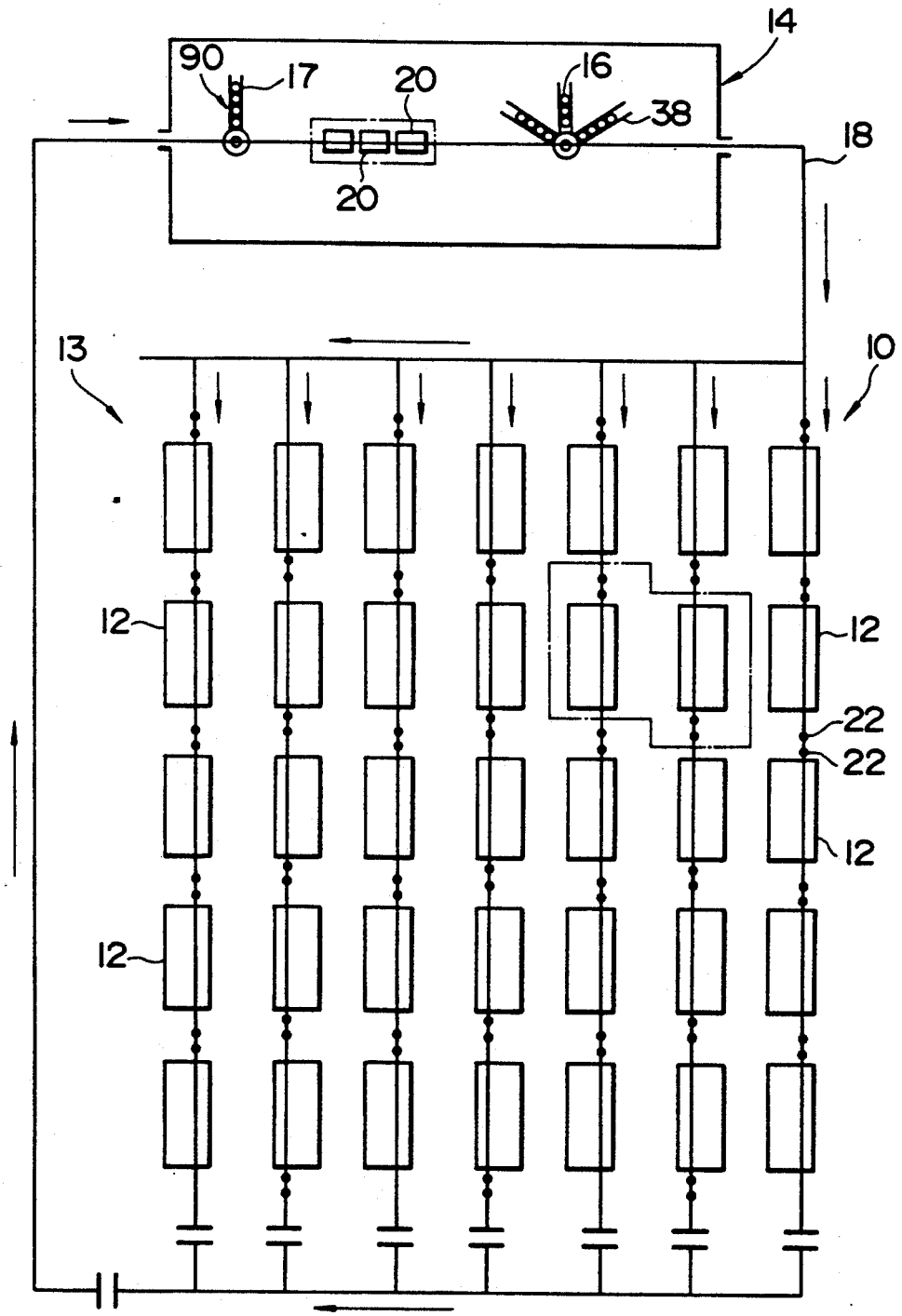
FIG. 1 is a plan view of a weaving factory schematically showing a storage station and carriers, respectively, to which the present invention is applied.

Referring now to FIG. 1 showing schematically a weaving factory 10, the weaving factory 10 is equipped with a weaving machine installation region 13 where a majority of weaving machines 12 are arranged in a plurality of rows, and a storage station 14 for storing full packages 16 of wefts supplied to each weaving machine 12.

The full packages 16 within the storage station 14 are transferred by a carrier 20 to a weft package stand 22 installed at the side of each weaving machine 12 and located right under a rail 18 attached to the ceiling of the weaving factory so as to place the full packages at the weft package stand. In the illustrated figure, the carrier is called as a doffer which is suspended by the rail 18 and can travel in the direction shown by an arrow along the rail.

In the illustrated embodiment, the three kinds of full packages 16 having a different weft respectively are prepared within the storage station 14, and the two kinds of full packages 16 of the three are supplied to each weaving machine 12. Therefore, two weft package stands 22 corresponding to two kinds of wefts are disposed at the side of each weaving machine 12. Needless to say, the present invention is applicable to the case where a single kind of the full packages having a same weft are supplied, that is, the case where one weft package stand is used as well.

Figure 2:
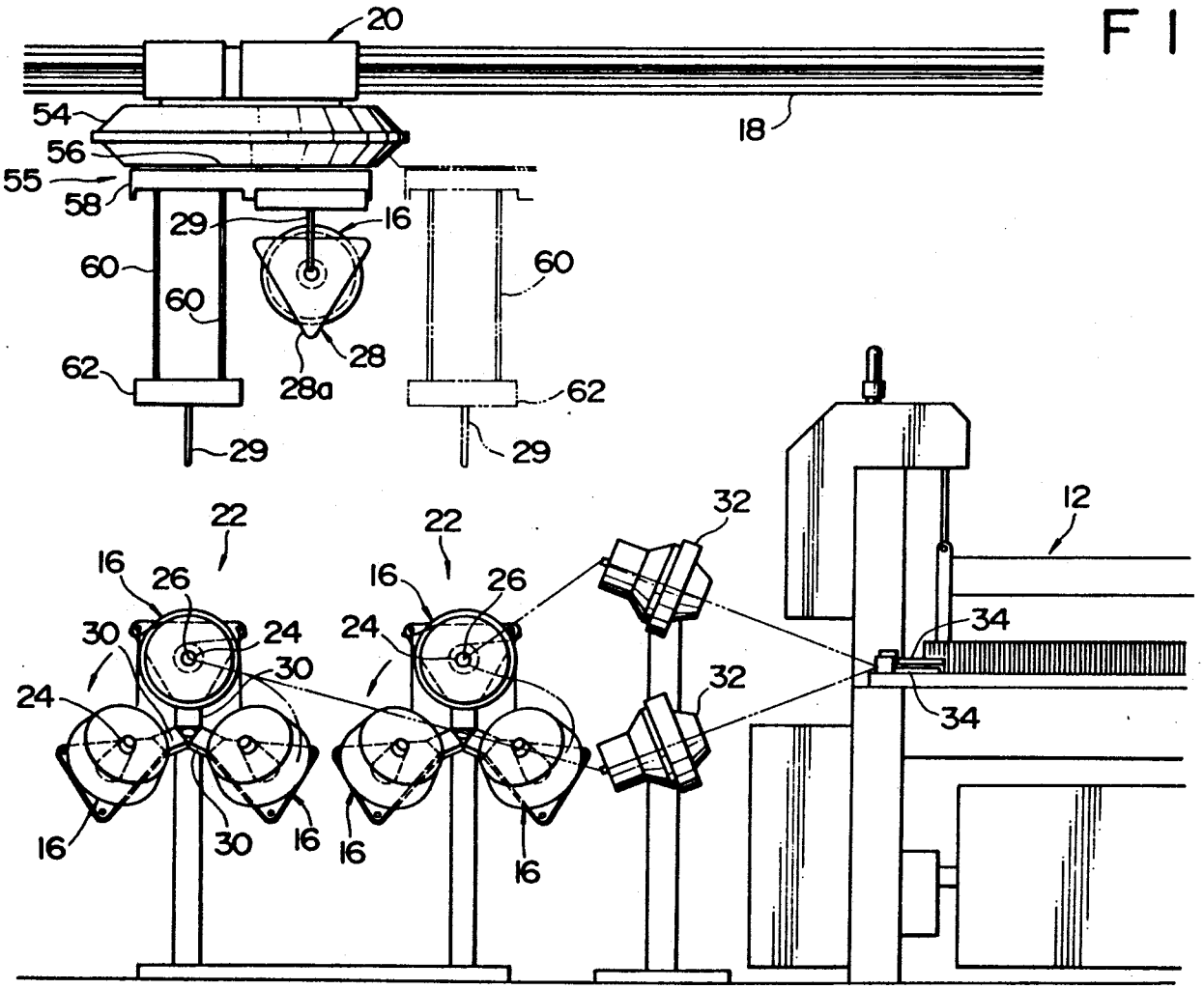
FIG. 2 is a front view showing a carrier and weft package stands, respectively.
Figure 3:
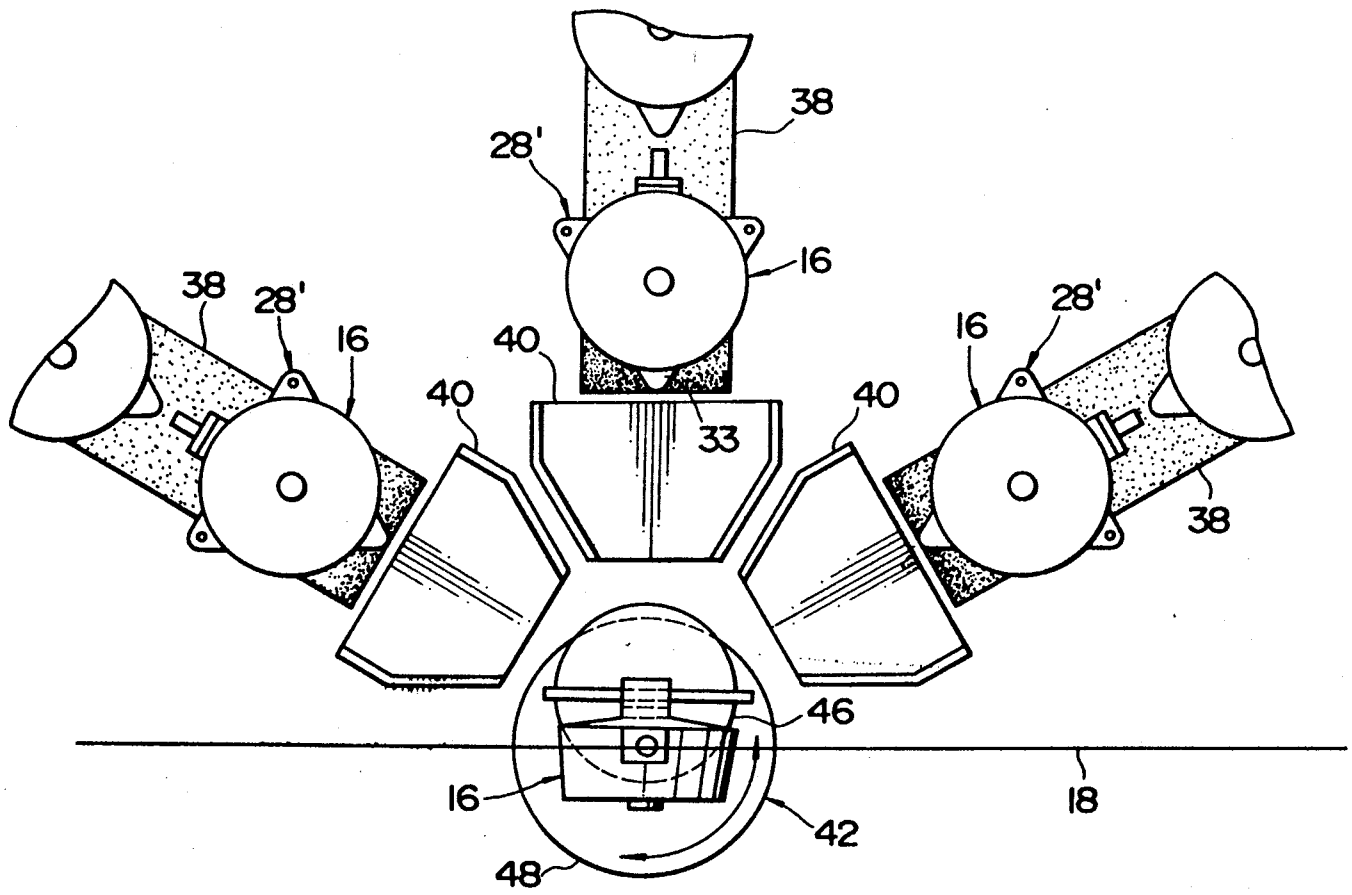
FIG. 3 is a schematic plan view showing a direction adjusting device at the storage station.

As shown in FIG. 2, the full packages 16 are accepted in a predetermined direction so that each weft package stand 22 may smoothly supply wefts to each weaving machine 12. In more detail, each weft package stand 22 supports three full packages 16 so that the axes of respective full packages 16 may intersect at a yarn guide 26 (shown by dots for illustrative purposes) and the small-diameter end portion of each full package may face toward the yarn guide 26.

A tray 28 is installed to each full package 16 for transferring and holding each full package. The tray 28 is composed of a plate portion 28*a* having an overall right triangular plane shape, and a support shaft portion 28*b* which projects from a roughly center portion of this plate member and which is insertable into the bobbin 24 of the full package 16 and engageable with the bobbin 24 (refer to FIG. 8).

The illustrated carrier 20 has two pairs of ascendable and descendable arms 29. The full package 16 is held by the carrier 20 by inserting the bent top end portion of each pair of arms 29 into front insides of the bobbin 24 and a concave portion 31 (refer to FIG. 8) attached to the plate portion 28*a* of the tray 28, and then the full package 16 is transferred in this condition.

Each weft package stand 22 is provided with three sockets 30 (refer to FIGS. 2 and 7) which can accept one of the vertex portions 33 in the triangle of the plate member 28*a* of the tray so as to hold the full package 16. The three sockets 30 are located at an accepting position, a waiting position and a releasing position for the full package 16, respectively, during weaving. When the weft of each weft package 16 in the releasing position runs out or when any end breakage happens, the corresponding three sockets rotate counterclockwise (in the direction shown by an arrow), and their positioning is made at another position in turn.

Each weft of full packages 16 located at the releasing position is guided to each corresponding weft jet nozzle 34 through each corresponding yarn guide 26 and each corresponding weft measuring apparatus 32.

In addition, the yarn tail end of the weft package 16 located at the releasing position and the yarn leading end of the full package 16 located at the waiting position are preliminarily held by a suction pipe (not shown), respectively, guided to a knotter (not shown) and tied together with each other at the knotter. Besides, both yarn ends of the wefts of the full package 16 have been passed through the holes at the other two vertex portions of the plate portion 28*a* of the tray, and a yarn ends are drawn out from the holes by means of a suction pipe (not shown).

In the weaving machines 12 placed side by side and in two rows, for example, in a couple of weaving machines 12 enclosed by chain line in FIG. 1, their take-up sides are disposed back to back with each other. The full package accepting direction at the weft package stand 22 is followed to the orientation of the weaving machines. In case where the carrier 20 travels along each travel path installed every each row of the weaving machines 12 in the same direction, the relative relation between the full package accepting direction at the weft package stand in the above-mentioned two weaving machines and the travelling direction of the carrier is different at 180° from each other. In this manner, since the relative relation between the full package accepting direction and the travelling direction of the carrier is different depending on the weft package stand 22, the full packages 16 must be prepared so as to agree to the full package accepting direction at the weft package stand 22 preliminarily requested.

In the present invention, for making the full package 16 faced to a predetermined direction, at least one of the storage station 14 of the full packages 16 and the carrier 20 is provided with a device for adjusting the direction of each full package 16.

Referring now to FIGS. 3 through 6, the three kinds of full packages 16 having a different weft respectively within the storage station 14 are disposed, respectively, on three belt conveyers 38 radially installed at an approximately equal space angle.

In the illustrated embodiment, a modified tray 28' is applied to each full package 16. The tray 28' has a plate member 28'a and a support shaft portion 28'b in similar to the plate portion 28a and the support shaft portion 28b of the tray 28 shown in FIG. 2, and in addition, has an L-shaped plate portion 28'd provided on the opposite side to one vertex portion of the plate portion 28'a and a cylindrical handled portion 28'c fixed to the L-shaped plate portion. On the other hand, the carrier has a handle member (not shown) capable of holding the handled portion 28'c of the tray instead of the arms 29.

Each full package 16 is disposed so that the plate portion 28'a of the tray 28' may be brought into contact with a conveyor belt, the above-mentioned one vertex portion of the plate portion 28'a may direct to the downstream side of the belt conveyer 38, and a support shaft 28'b which will be described later may be directed upwards. The full packages 16 on the three belt conveyers 38 are delivered to a direction adjusting device 42 through three guide devices 40, respectively.

Figure 4:
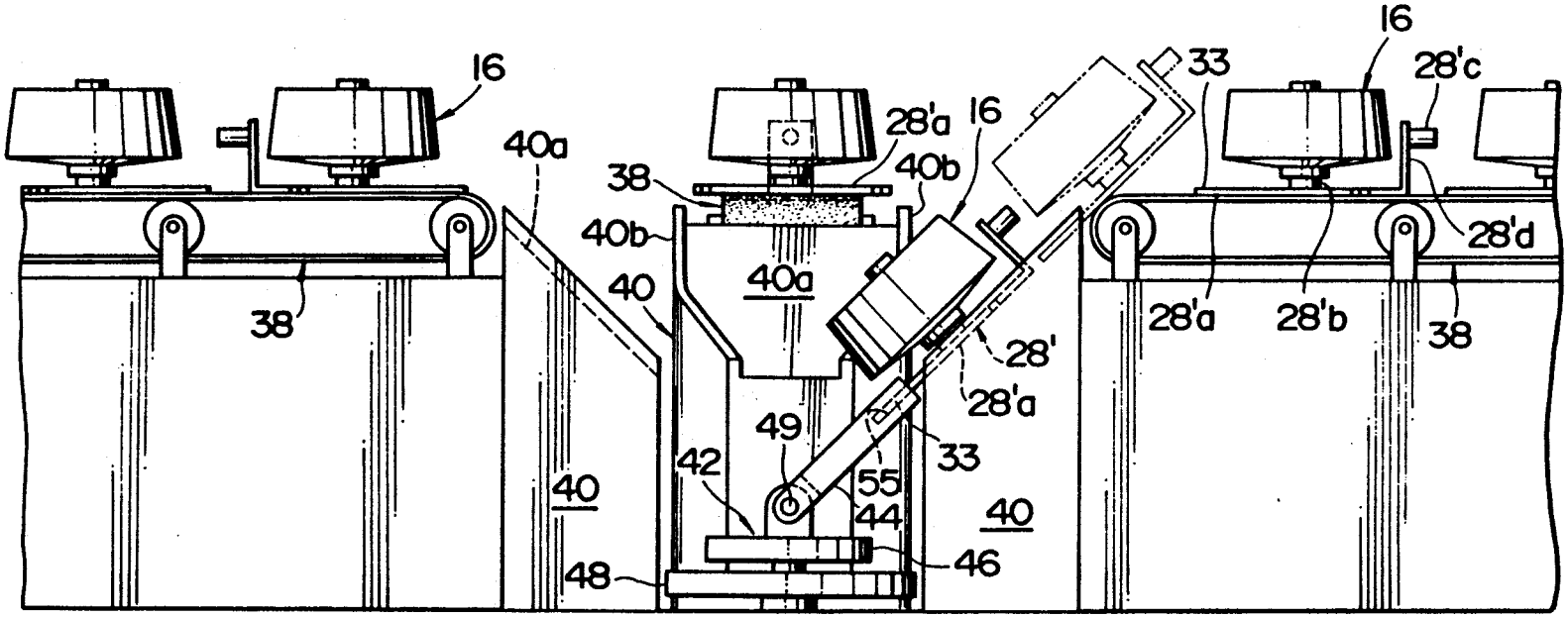
FIG. 4 is an enlarged-scale front view showing the direction adjusting device of FIG. 3, when a holding member is in an inclined condition.
Figure 5:
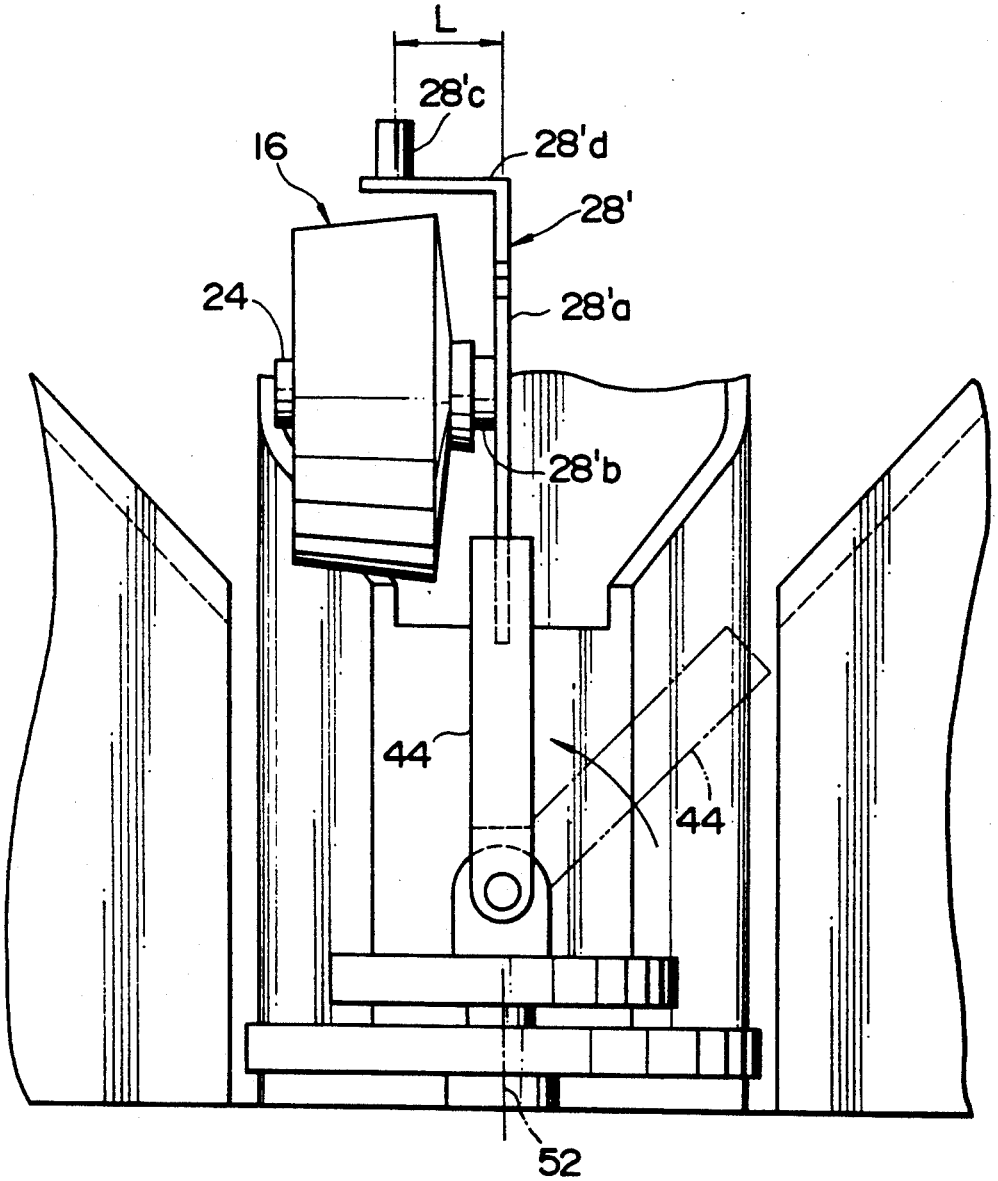
FIG. 5 is an enlarged-scale front view showing a case where the holding member is in a perpendicular condition.

As shown in FIG. 4, each guide device 40 is provided between each belt conveyor 38 and the direction adjusting device 42, and accepts the full package 16 which slips down from the downstream end portion of each belt conveyer 38. The guide device 40 has an inclined face 40a, on which the plate portion of the tray can slide, and a pair of guide walls 40b for guiding one vertex portion of the plate portion of the tray so that one vertex portion may fall down to a front, whereby the guide device guides the full package 16 to the direction adjusting device 42.

However, in the illustrated embodiment, the delivery of the full package 16 between the carrier 20 and the weft package stand 22 is carried out under the condition that the full package 16 is horizontally maintained. In addition, in the illustrated embodiment, the full package accepting direction at the weft package stand 22 is downward at a right angle to the rail 18 of the carrier 20.

In addition to this embodiment, there are such cases as where the full package maintains its inclination except horizontal and where the tray has its angle to the vertical plane including the rail 18. In the former case, a structurally modified tray is used, and in the latter case, the rotating angle of the full package 16 may be adjusted by the direction adjusting device.

The direction adjusting device 42 is provided with a holding member 44 for holding the full package 16, a rotating plate 46 for supporting the holding member 44, and another rotating plate 48 for supporting the rotating plate 46 and being rotatable around the axis eccentric from the rotating axis of the rotating plate 46. The eccentricity of the axis from the rotating axis is equal to a distance L (FIG. 5) between the plate portion 28'a of the tray and the handled portion 28'c. In the illustrated embodiment, each of the rotating plates 46 and 48 is composed of a small-diameter disc and a large-diameter disc, respectively.

The illustrated holding member 44 shows a plate shape as an overall shape and has a lower end portion pivotally attached to the center portion of the rotating plate 46 through a pin 49 extending longitudinally, and an upper end portion provided with a concave portion 50 having an approximately triangular plane shape for allowing the acceptance of one vertex portion 33 of the plate portion 28'a of the tray. The concave portion 50 is opened to the upper end of the holding member 44.

The holding member 44 can be made inclined or perpendicular by oscillating the holding member around the pin 49, and each inclined or perpendicular condition can be also maintained.

The holding member 44 is directed to a predetermined guide device 40 by rotating the small-diameter rotating plate 46. The inclined angle of the holding member 44 which is directed to the selected guide device 40 and inclined for accepting the full package 16 is same as the inclined angle of the inclined face 40a on the guide device 40, and under its inclined condition, the upper end portion of the holding member 44 is adjacent to the inclined downward portion of the inclined face 40a.

From this reason, the full package 16 slid down from the inclined face 40a is fitted into the concave portion 50 of the holding member 44 for waiting downwards at the inclined face 40a, in the above-mentioned one vertex portion 33 of the plate portion 28'a of the tray, and as a result, such the full package 16 is held by the holding member 44 (FIG. 4).

Figure 6:
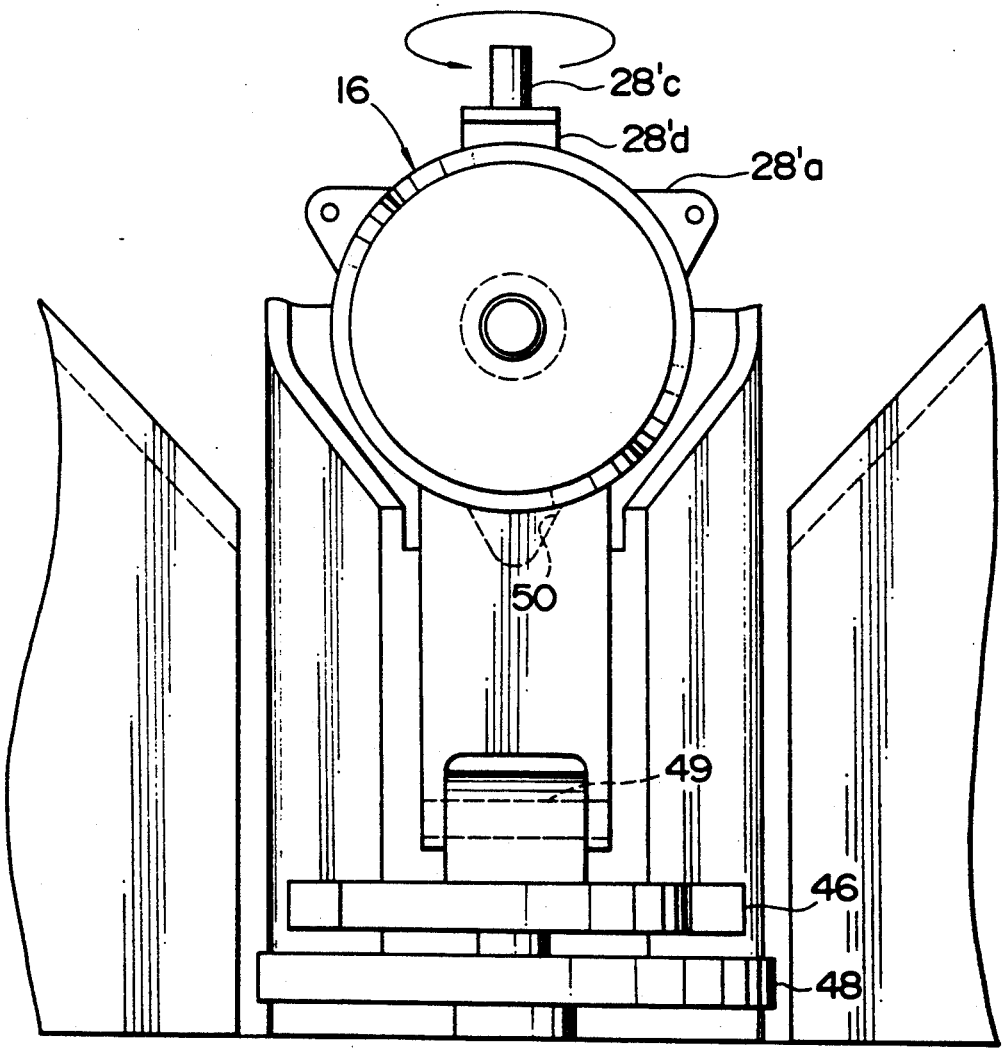
FIG. 6 is an enlarged-scale front view showing the holding member after its rotation.

After the holding member 44 is kept in its perpendicular condition (FIG. 5), the handled portion 28'c is positioned on the rotating axis 52 of the large-diameter rotating plate 46. Furthermore, the direction of the full package 16, that is, the direction of the bobbin 24 is altered by rotating the large-diameter rotating plate 48 in accordance with the full package accepting direction at the weft package stand 22 for requesting the full package 16 (FIG. 6). Specifically, the rotating position depends on the full package accepting direction at the weft package stand 22 for requesting the full package 16 and the advancing direction of a predetermined carrier into the rows of the weaving machines.

The handle member of the carrier is located at the down side of the rail 18, and the rotating axis 52 crosses with the rail 18. As above-described, when the large-diameter rotating plate 48 is rotated, the handled portion 28'c of the tray is always positioned on the rotating axis 52, even though the large-diameter rotating plate 48 is rotated, since the axis positioning of the handled portion 28'c is preliminarily made on the rotating axis 52 of the large-diameter rotating plate 48. Therefore, accordingly, in any direction of the full package, the carrier can hold the full package 16 at a certain position.

Furthermore, either of the trays 28 and 28' is applicable to the carrier 20 having the arm 29, and when the carrier having the arm 29 is used, the direction of the full package 16 can be set in two different ways with 180° rotating phase.

Only the large-diameter rotating plate 48 may be provided by omitting the small-diameter rotating plate 46. At this time, each belt conveyor 38 and each guide device 40 are provided so that each belt conveyor 38 and each center line of each guide device 40 may cross with the rotating axis 52 of the large-diameter rotating plate 48. The tray 28 or a tray having the handled portion 28' located on the axis of the plate portion 28'a can be used.

Referring again to FIG. 2, the alternation of the direction of the full package done in the carrier 20 will be described.

The carrier 20 includes a main body 54 which is its running part on the rail 18, a rotating shaft portion 56 extending downwards from the main body 54 and carrying a direction adjusting device 55, a rotating portion 58 fixed to the rotating shaft portion, and two pairs of wires 60 which can extend and roll up from the rotating portion 58. Each pair of arms 29 is oscillatably attached to an arm holding portion 62 fixed to the lower end of each pair of wires 60.

The direction of the full package 16 held by both arms 29 can be altered and adjusted by rotating the rotating portion 58 around an axis thereof.

Such a carrier can be used which is made by replacing the illustrated two pairs of arms 29 with a pair of arms and by fixing the arm holding portion for the above-mentioned one pair of arms directly to the rotating shaft portion 56.

In either case, the direction of the full package 16 held by both arms 29 can be altered by rotating the rotating portion 58.

The transfer and supply of the full packages by the illustrated carrier 20 can be done in the following.

To begin with, in the storage station 14, a pair of arms 29 opened to each other by oscillation are descended, then, both arms 29 are closed and these end portions are inserted into the front insides of the bobbin 24 and the concave portion 31 of the tray. After then, both arms 29 are lifted, and then, the carrier 20 is made to run to the objective weft package stand 22.

The carrier 20 is stopped, for example, so that another pair of arms holding no weft package 16 may be positioned at the upper portion of the objective weft package stand, another pair of arms holding no weft package 16 are descended so as to recover the empty package 17 held by the weft package stand 22, and the empty package 17 is held together with the tray 28 and then ascended.

When the full package 16 is not preliminarily directed to a predetermined direction in the storage station 14 or in a case where the storage station 14 does not have the above-mentioned direction adjusting device and the full package 16 is not directed to a predetermined direction, after then, the full package 16 is directed to a predetermined direction and simultaneously the held full package 16 is located right above the weft package stand 22 by rotating the rotating portion 58 through 180°. Then, as shown in FIGS. 7 and 8 in turn, the full package 16 is descended by releasing the wire 60 and one vertex portion 33 of the tray of the full package is inserted into the socket 30 from which the empty package 17 is removed.

When the full package 16 is directed to a predetermined direction, the carrier 20 is moved as it is along the rail 18 until the held full package 16 is positioned right above the weft package stand 22 without rotating the rotating portion 58 after recovering the empty package 17.

Figure 7C:
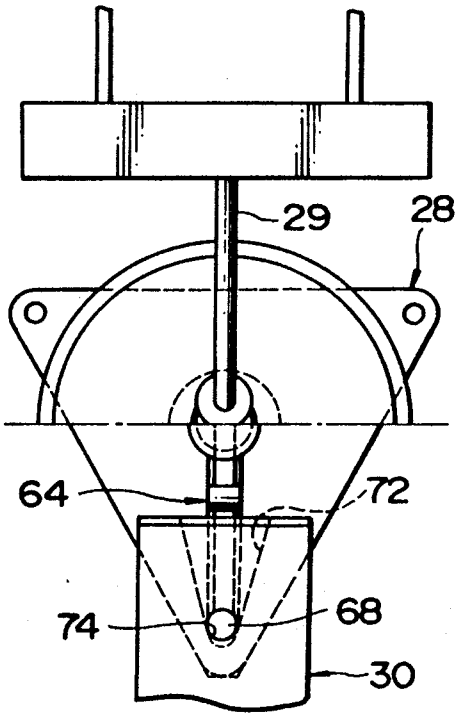
FIG. 7 is a partial front view showing a process until a full package right above the weft package stand is installed to the weft package stand, in which FIG. 7(*a*) shows a condition that the full package is available right above the weft package stand, and FIGS. 7(*b*) and (*c*) show a condition that the full package is accepted in the weft package stand, respectively.
Figure 7B:
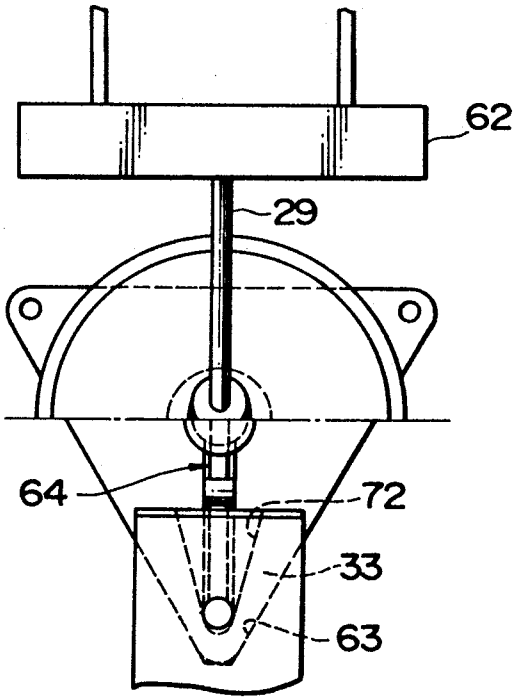
Figure 7A:
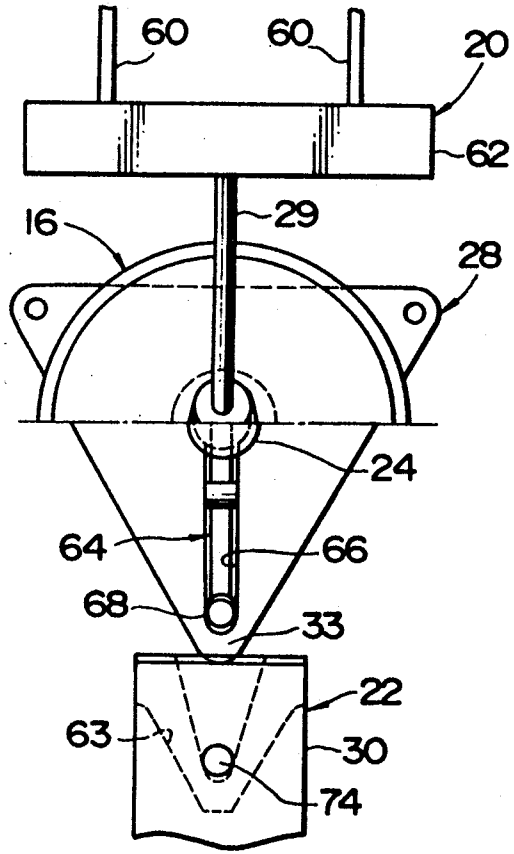
Figure 8C:
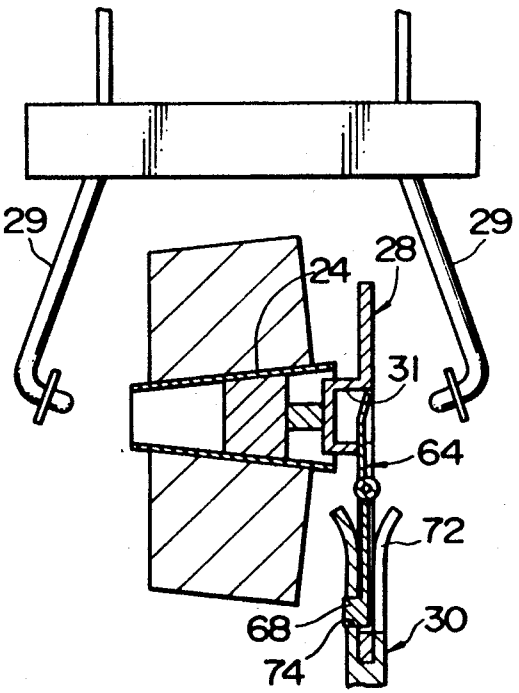
FIG. 8 is a partial sectional view showing a process until a full package right above the weft package stand is installed to the weft package stand, in which FIG. 8(*a*) shows a condition that the full package is available right above the weft package stand, and FIG. 8(*b*) and (*c*) show a condition that the full package is accepted in the weft package stand, respectively.
Figure 8B:
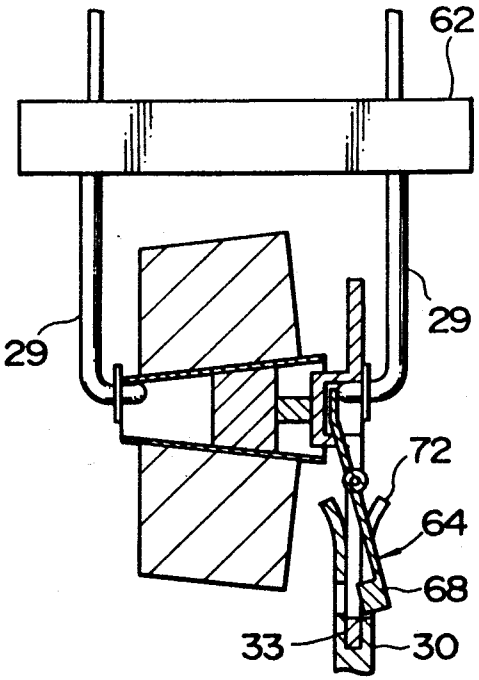
Figure 8A:
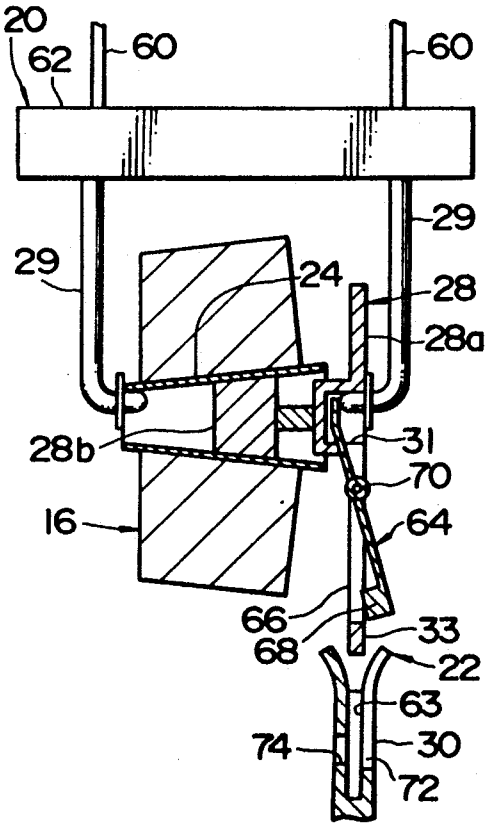

As shown in FIGS. 7 and 8, the socket 30 has an opening approximately equal to the plane shape of one vertex portion 33 of the tray 28 at its side and its upper end, that is, a triangular concave portion 63, and its upper end is expanded upwards so as to easily accept one vertex portion 33.

Furthermore, the tray 28 is provided with a lock member 64 so as to prevent one vertex portion 33 accepted to the socket 30 from escaping.

The lock member 64 is disposed in a slot 66 provided in the plate member 28'a of the tray 28 and extending toward one vertex portion 33 from its concave portion 31 and in the concave portion 31. The lock member 64 is composed of a plate member provided with an upper end portion, with which the top end portion of one arm 29 of the carrier 20 can make contact, and a lower end portion having a projection 68 projecting into the side of the support shaft portion 28b, that is, the side of the other arm 29, and such lock member can rotate around an axis 70 in the slot 66. A spring (not shown) applies a clockwise force to the lock member 64 in the sectional view of FIGS. 8(*a*)–8(*c*).

When the full package 16 is held with both arms 29 of the carrier 20, the lock member 64 is in the condition shown in FIGS. 7(*a*) and 8(*a*), that is, the condition that the lock member 64 receives a push pressure by one arm 29 at its upper end portion and rotates angularly, and the lower end portion thereof is in its partially escaped condition.

The socket 30 of the weft package stand has a cut-out 72, through which the lower portion of the lock member 64 can be passed, and a hole 74, into which the projection 68 of the lock member 64 can be fitted. Therefore, as shown in FIGS. 7(*c*) and 8(*c*), both arms 29 are oscillated toward their mutually opened direction, and when both arms 29 are apart from the bobbin 24 and the concave portion 31, the lock member 64 is oscillated clockwise due to the above-mentioned spring force. As a result, the projection 68 fits into the hole 74, and the pulling-out of the tray 28 from the socket 30 is prevented. Needless to say, when the tray 28, therefore, the weft package (the empty package 17 or the full package 16) is removed from the socket 30, both arms 29 of the carrier 20 are oscillated in the direction for closing with each other, and these arms are inserted into the bobbin 24 and the concave portion 31 of the tray. Then, the lock member 64 anguarly rotates counterclockwise against the above-mentioned spring force, and the projection 68 comes out of the hole 74. Thus, the top end portion of the tray 28 can be pulled out from the concave portion 63 of the socket.

Subsequently, the arms 29 are ascended, and the carrier 20 is returned to the storage station 14.

In the case of the embodiment of the carrier having only a pair of arms or only a set of handle members, needless to say, the full package 16 is supplied to the weft package stand after the recovery of the empty package 17 by another carrier. In this case, the arms or the handle members are rotated during transfer or at the upper side of the weft package stand so as to alter the direction of the transferred full package.

The storage station 14 is provided with an accepting device 90 (FIG. 1) for the recovered empty package 17 on the path of the carrier 20. The bobbin 24 is removed from the tray 28 at here and then, the empty tray is presented again for the supply of the full package.

In addition, for example, in case where two weft package stands are disposed at each weaving machine and the respective full package accepting directions are different from each other in two weft package stands, the relative relation between the accepting direction and the travel direction of the carrier becomes different. Therefore, even in such a case, the direction of the full package must be also set up by the direction adjusting device so as to correspond to the accepting direction of the weft package stand.

Figure 9:
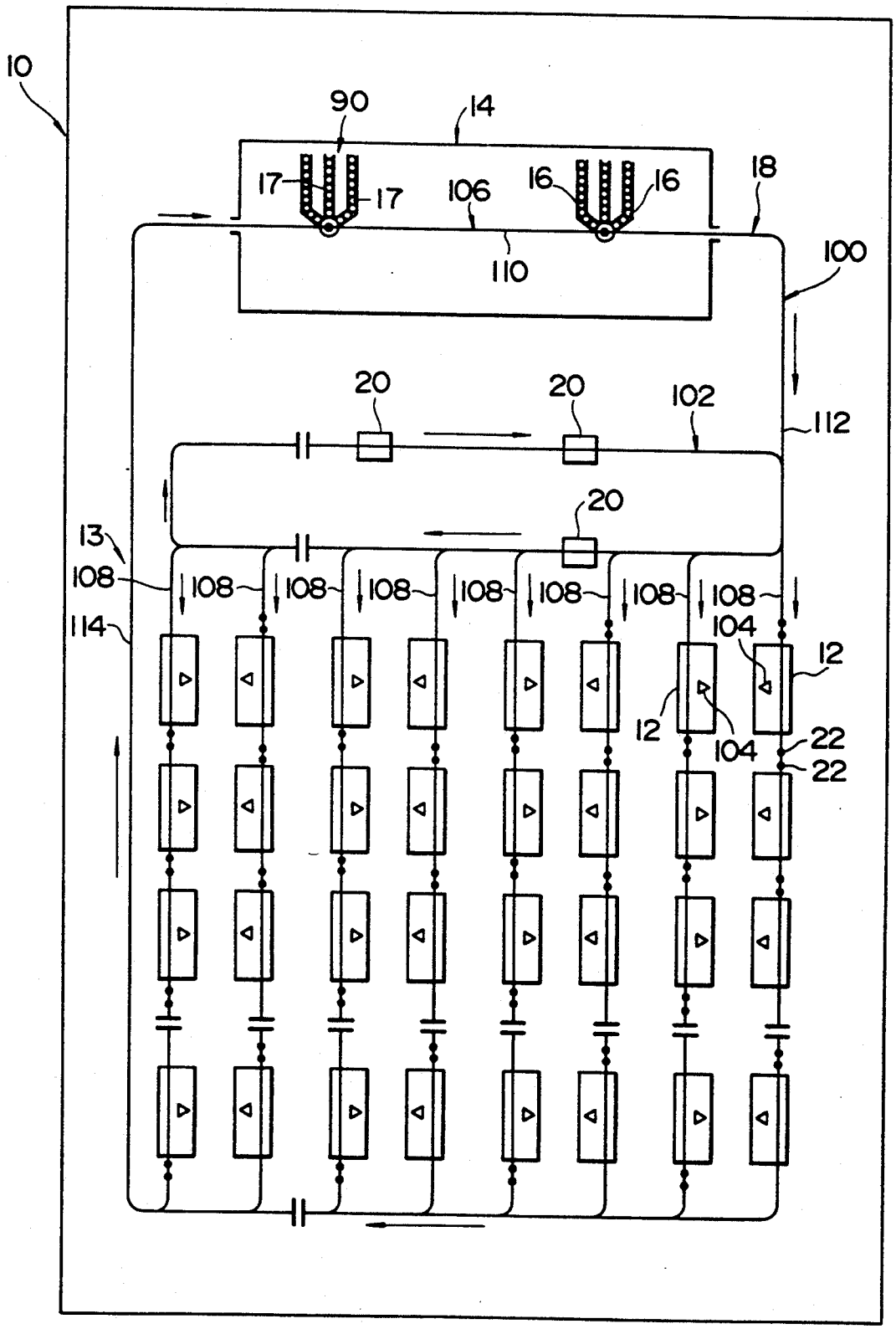
FIG. 9 is a schematic plan view showing a weaving factory.
Figure 10:
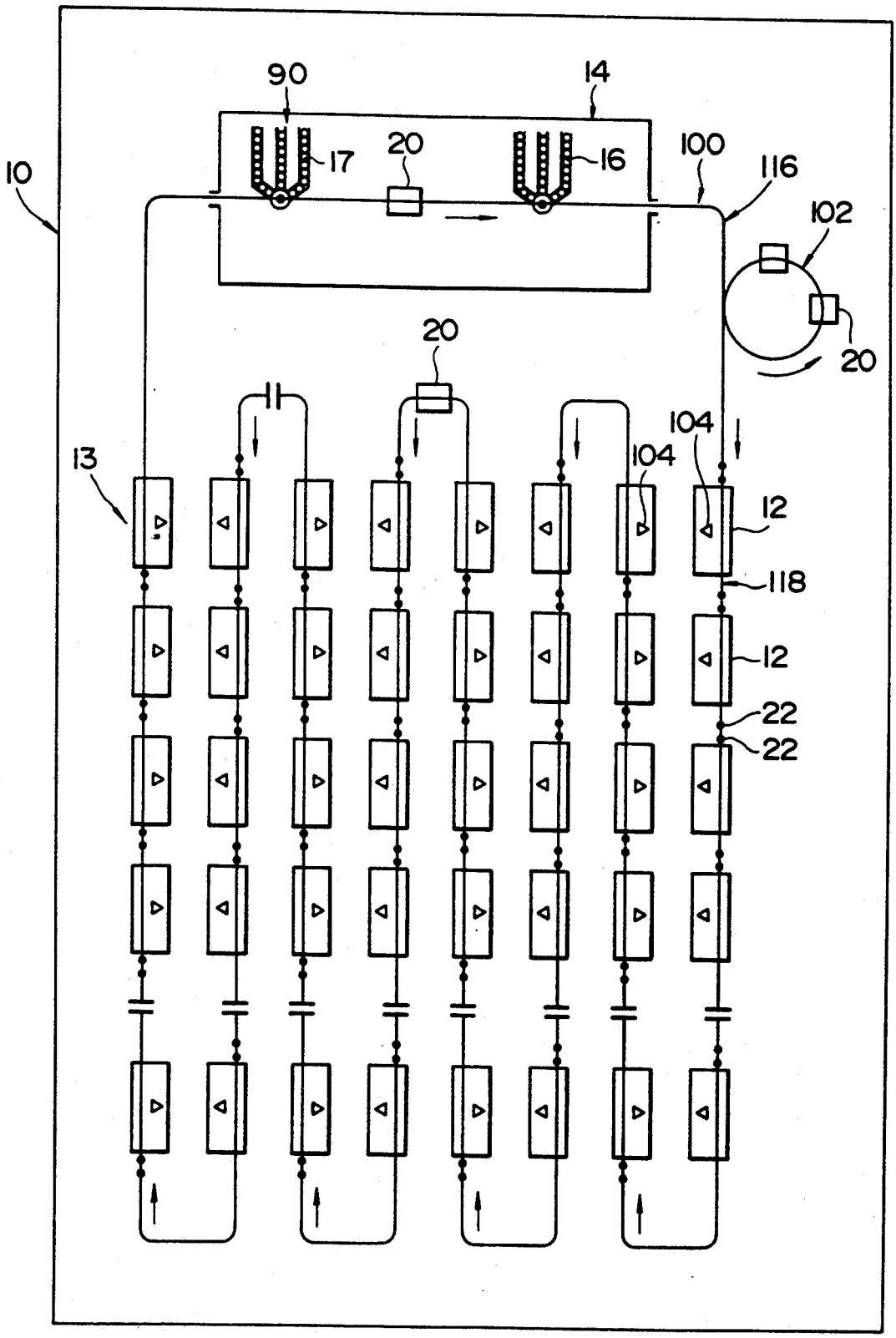
FIG. 10 is a schematic plan view showing another embodiment of the weaving factory.

It is desirable that the rail 18 for the carrier 20 comprises a main rail 10 and a closed loop subrail 102 connected to the main rail 100, as shown in FIGS. 9 and 10.

Similarly, the weaving machines 12 in a plurality of rows (eight rows in the illustrated embodiment) are disposed in the weaving machine installation region 13, and in consideration of weaving efficiencies, mutually adjacent weaving machines 12 in two rows are opposite to each other, that is, such weaving machines 12 are directed to one side and another side of the lateral direction indicated by one vertex of the illustrated triangle 104.

The main rail 100 is composed of a first rail portion 106,116 extending through the storage station 14, and a second rail portion 108,118 connected to the first rail portion 106 and extending along each weaving machine row in the weaving machine installation region 13.

In more detail, referring to FIG. 9, the first rail portion 106 is composed of a rail portion 110 passing through the storage station 14 and extending in a lateral direction, a rail portion 112 extending from one end of the rail portion 110 in a longitudinal direction and connected to one end side of the second rail portion 108 and a rail portion 114 extending from the other end of the rail portion 110 in a longitudinal direction and connected to the other end side of the second rail portion 108.

Each second rail portion 108 extends in a crank shape as a whole except the utmost right portion extending in an L shape as a whole, and connects at its one end and the other end to one end and the other end of the neighboring left and right second rail portions 108. Each carrier 20 can move on each second rail portion 108 from its one end to the other end in a direction indicated by an arrow.

The subrail 102 has a rectangular shape as a whole in the illustrated embodiment, and in one short side portion of the above-mentioned rectangular shape, the subrail 102 coincides with a rail part 112 of the first rail portion 106. In one long side portion of the above-mentioned rectangular shape, the subrail 102 further coincides with one end portion of each second rail portion 108. Therefore, the subrail 102 can be connected to both of the first rail portion 106 and the second rail portion 108.

A plurality of carriers 20 loading the full packages having the different kinds of wefts required to the weaving machine 12 are forwarded in turn to the subrail 102 through the rail part 112 of the first rail portion 106. Each carrier forwarded to the subrail 102 circulates through the subrail 102 and waits here until the supply of the full package is requested by the weaving machine 12.

By circulating the carriers 20 in the above-mentioned closed loop, that is, the subrail 102, the carrier 20 loading the full package fitted to the kind of weft requested by the weaving machine 12 is selected at an arbitrary point on the subrail 102, and then, the selected carrier 20 can be sent from the subrail 102 to the second rail portion 108.

In the embodiment shown in FIG. 9, as described above, the second rail portion 108 is connected in parallel, and the carrier 20 can move on each second rail portion 108 in one direction, that is, from the upper end to the lower end in the figure.

On the other hand, in an embodiment shown in FIG. 10, the second rail portion 118 constructing the main rail 100 together with the first rail portion 116 extends along each row of the weaving machines and is connected in series with each other, and the carriers 20 can move in turn along both rows of the mutually adjacent weaving machines to one direction and to the other direction. Both ends of the first rail portion 116 showing an inverted U-letter shape are connected to one end and the other end of the second rail portion 118, respectively.

Since other points about the first rail portion 116 are similar to those about the first rail portion 106 shown in FIG. 9, the same symbols used in FIG. 1 are used for the equivalent parts in FIG. 10.

The subrail 102 shown in FIG. 10 has a round shape as a whole and is brought into contact with the first rail portion 116. Even in this embodiment, a plurality of carriers 20 circulate through the subrail 20 and can wait here until the supply request from the weaving machine 12 is available. Each carrier 102 on the subrail 102 can move to the second rail portion 118 through the first rail portion 116.

Needless to say, the subrail is good enough if only it is in a closed loop form, and it is not restricted to the rectangular and round shapes. Furthermore, the full package may be formed by a single kind of weft as well.

What is claimed is:

1. In combination with a weft package stand of a weaving machine a storage station for full weft packages transferred to a weft package stand of a weaving machine by a carrier, said storage station including a direction adjusting device for arranging the direction of said full packages in the direction corresponding to a full package accepting direction of said weft package stand.

2. A storage station for full weft packages according to claim 1, wherein said direction adjusting device includes a holding member for holding said full package and a rotating plate for supporting said holding member.

3. A storage station for full weft packages according to claim 1, wherein said carrier has a pair of handle portions, said full package has a handled portion held by a pair of said handle portions, and said direction adjusting device includes a holding member, for holding said full packages, a first rotating plate for supporting said holding member around a first axis, and a second rotating plate for supporting said first rotating plate, said second rotating plate having an axis which is eccentric from the first axis.

4. A carrier for transferring full weft packages from a storage station to a weft package stand of a weaving machine and arranging the full packages at said weft package stand, said carrier including a direction adjusting device for arranging a direction of said full packages in the direction corresponding to a full package accepting direction of said weft package stand, said direction adjusting device having at least a pair of ascendible and descendible arms for supporting a full package and including means for rotating said arms around an axis perpendicular to said carrier.

* * * * *